US007931014B2

(12) United States Patent
Masaoka et al.

(10) Patent No.: US 7,931,014 B2
(45) Date of Patent: Apr. 26, 2011

(54) KICKBACK PREVENTING CIRCUIT FOR ENGINE

(75) Inventors: Akira Masaoka, Shizuoka (JP); Atsushi Shimoishi, Shizuoka (JP)

(73) Assignee: Yamaha Motor Electronics Co., Ltd., Shizuoka (JP)

( * ) Notice: Subject to any disclaimer, the term of this patent is extended or adjusted under 35 U.S.C. 154(b) by 0 days.

(21) Appl. No.: 12/963,784

(22) Filed: Dec. 9, 2010

(65) Prior Publication Data

US 2011/0073084 A1 Mar. 31, 2011

Related U.S. Application Data

(60) Continuation of application No. 11/307,412, filed on Feb. 6, 2006, now abandoned, which is a division of application No. 10/605,843, filed on Oct. 30, 2003, now abandoned.

(30) Foreign Application Priority Data

Nov. 26, 2002 (JP) ..... 2002-342256

(51) Int. Cl.
*F02P 11/02* (2006.01)
*F02P 11/00* (2006.01)

(52) U.S. Cl. ..... 123/631

(58) Field of Classification Search ..... 123/631, 123/630, 179.5, 179.28, 179.6, 632, 595, 123/319, 198 D, 198 DB, 406.58
See application file for complete search history.

(56) References Cited

U.S. PATENT DOCUMENTS

| | | | | |
|---|---|---|---|---|
| 4,080,940 | A * | 3/1978 | Fuzzell et al. | 123/333 |
| 4,909,229 | A | 3/1990 | Hashizume | |
| 5,020,506 | A * | 6/1991 | Ozawa | 123/631 |
| 5,778,862 | A * | 7/1998 | Fukui | 123/631 |
| 6,435,158 | B1 * | 8/2002 | Mingo et al. | 123/198 D |
| 6,786,212 | B1 * | 9/2004 | Choi | 123/631 |

FOREIGN PATENT DOCUMENTS

| | | | |
|---|---|---|---|
| JP | 55-12235 | A | 1/1980 |
| JP | 61-226568 | A | 10/1986 |
| JP | 1-106975 | A | 4/1989 |

OTHER PUBLICATIONS

Masaoka et al.: "Kickback Preventing Circuit For Engine"; U.S. Appl. No. 10/605,843, filed Oct. 30, 2003.
Masaoka et al.: "Kickback Preventing Circuit For Engine", U.S. Appl. No. 11/307,412, filed Feb. 6, 2006.

* cited by examiner

*Primary Examiner* — Mahmoud Gimie
(74) *Attorney, Agent, or Firm* — Keating & Bennett, LLP

(57) ABSTRACT

An ignition control circuit and method of operation provides a very simple but highly effective prevention of engine reverse rotation upon starting by prohibiting ignition when a reverse rotation situation arises.

4 Claims, 4 Drawing Sheets

KICKBACK PREVENTING CIRCUIT FOR ENGINE

BACKGROUND OF THE INVENTION

1. Field of the Invention

This invention relates to an ignition system for an internal combustion engine and more particularly to an ignition system including an arrangement for precluding the occurrence of reverse rotation running, particularly during starting of the engine.

2. Description of the Related Art

Spark ignited internal combustion engines generally include engine driven electrical generators for providing the electrical power to fire the ignition system. This may be done directly from the generator, as in the case of magneto ignition, of from the battery charging system of battery carrying machines. The timing of firing of the spark plug is controlled by a pulser coil that cooperates with a timing mark on the engine flywheel. These timing marks have a particular circumferential extent and generate positive and negative pulsed as the leading ad trailing ends pass the pulser coil.

To start the engine it is cranked in one of several manners. This cranking may be done by an electrical starter motor or manually by a kick starter, pull rope or crank, for example. The spark plug or plugs are then fired in response to a pulse signal from the pulser coil. However, at the time of original engine rotation the turning force applied may not be sufficient to resist the internal pressure generated in the combustion chamber. The internal pressure, if it overcomes the cranking force may cause the engine to rotate in a direction opposite to that desired. However the pulser coil will still create a pulse, in this instance from the trailing edge of the timing mark, and combustion will be initiated. Some engines, particularly two stroke ones can and will run in either direction. This presents significant problems both to the engine and its related equipment as well as to the starter and possibly even the operator.

A system has been proposed in Japanese Published Application Hei 9-151836 to avoid this problem. As disclosed in that application, in addition to the normal pulser coil and timing mark, a generator has at least two coil windings that output electrical energy as the engine rotates. These coil windings output sinusoidal wave outputs having positive and negative portions. The system includes a generator output polarity discriminating circuit which compares the polarity phase when the pulser coil is triggered and if the engine speed is below a predetermined value. From this the direction of crankshaft rotation is determined. If it is reversed from that desired, ignition is precluded.

The problem with this arrangement is that the timing mark must be located to register with the pole magnets of the generator to work. This compromises both the positioning and timing of the timing mark and the number of poles and coils in the generator.

SUMMARY OF THE INVENTION

It is therefore a principal object of this invention to provide a very simple and effective arrangement and method for preventing reverse rotation without affecting either the timing or generating system.

This invention is adapted to be embodied in a method for preventing a reverse rotation of an engine. The method comprises the steps of determining if a predetermined monitoring condition for monitoring a reverse rotation of the engine is satisfied and determining if an operation of a starter motor has stopped, when the monitoring condition is satisfied. Then it is determined if the reverse rotation of the engine is occurring, when the operation of the starter motor has stopped. If so the an operation of the engine is stopped by stopping at least one of fuel injection and ignition of the engine when the reverse rotation of the engine is occurring.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
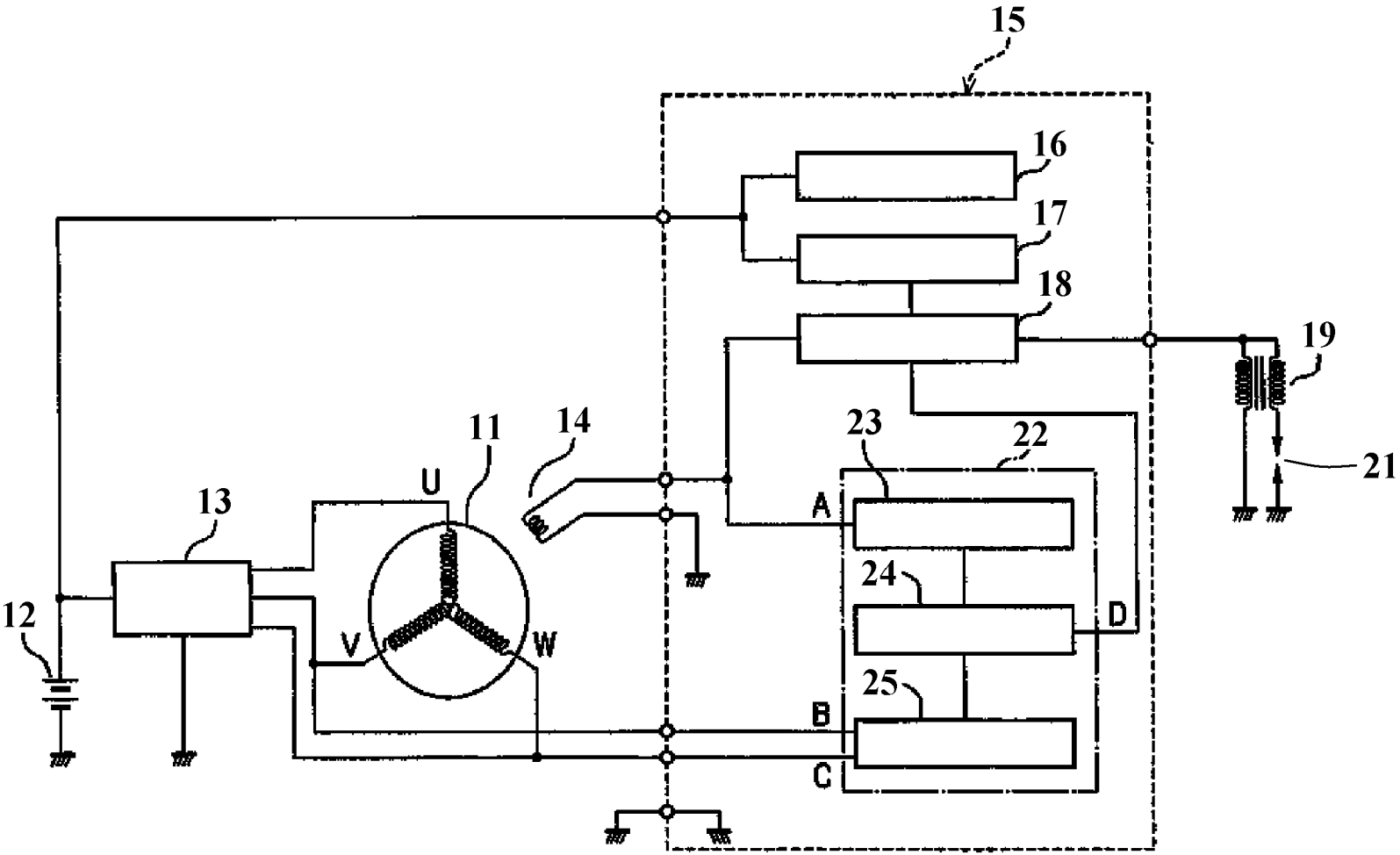
FIG. 1 is a partially schematic view of an electrical generating and ignition circuit for an internal combustion engine embodying the invention and performing a method in accordance with the invention.

Referring now in detail to the drawings and initially to FIG. 1, the electrical generating and ignition circuit for an internal combustion engine is illustrated in schematic form, for the most part. The generating system comprises a three-phase generator 111 fixed in a suitable manner adjacent to an end of an engine crankshaft (not shown). The stator of the generator 11 has coils wired in three phases with their output ends being indicated as U, V, and W. These coils cooperate in a known manner with permanent magnets fixed to a flywheel (not shown) that is attached to the aforenoted crankshaft end. The three phase output terminals U, V, and W of the coils are connected to a battery 12 via a regulator 13. The rectifier 13 both rectifies the output of the coil windings and acts to prevent excessive current.

In addition to the permanent magnets that cooperate with the coil windings as just described the flywheel is provided with a timing projection on its outer surface that cooperates with a pulser coil 14, as is also well known in the art. As the crankshaft rotates, the pulser coil 14 detects changes in the magnetic flux at both ends of the timing projection. The timing projection extends through an arc of, for example, about 60 degrees of crankshaft angle. This produces one positive and one negative pulse signals per revolution of the crankshaft.

The outputs of the pulser coil 14 are supplied to an ignition system indicated generally at 15 for carrying out the control of the engine ignition. The ignition system 15 is made up of a power supply circuit 16 connected to the battery 12, a booster circuit 17 for providing a desired specified ignition voltage, and an ignition control circuit 18 that receives the output from the pulser coil. These components may be of any desired type and form no part of the invention. Those skilled in the art will readily understand from the following description how the invention can be applied to any desired, basic ignition system connected to the pulser coil 14, The ignition circuit 18 supplies ignition voltage to an ignition coil 19. The output from the ignition circuit fires one or more spark plugs 21 at a crank angle position corresponding to an optimum ignition timing based on the pulse signal coming from the pulser coil 14 in any desired strategy according to the operating condition of the engine.

In accordance with the invention, a kickback preventing circuit 22 embodying the present invention is incorporated in the ignition system 15. The kickback preventing circuit 22 is comprised of a pulse receiving circuit 23, a reverse revolution discriminating circuit 24 and a generator output receiving circuit 25.

The pulse receiving circuit 23 is connected through a terminal A to the pulser coil 14 to receive pulse signals. The generator output receiving circuit 25 is connected through terminals B and C to any two of the phase terminals (V and W terminals in this example) of the generator 11 to receive output voltage of the generator 11. The reverse revolution discriminating circuit 24 detects, as will be described later, a reverse revolution condition based on the pulse signal from the pulse receiving circuit 23 and on the generator voltage from the generator output receiving circuit 25 and sends an ignition permitting or prohibiting signal to the ignition circuit 18 through a terminal D.

The details of the kickback preventing circuit 22 will now be described by particular reference to the circuit diagram shown in FIG. 2. The pulse receiving circuit 23 is made up of a diode D1 connected to the terminal A and a resistor R1. The generator output receiving circuit 25 is made up of diodes D2 and D3 connected to the terminals B and C, respectively: a capacitor C1; and resistors R5 and R8. The reverse revolution discriminating circuit 24 is made up of a flip-flop circuit made up of transistors Tr1 and Tr3 and a transistor Tr2 that is connected to the generator output receiving circuit 25. The collector of the transistor Tr1 is connected to the output terminal D of this reverse revolution discriminating circuit 24.

Figure 2:
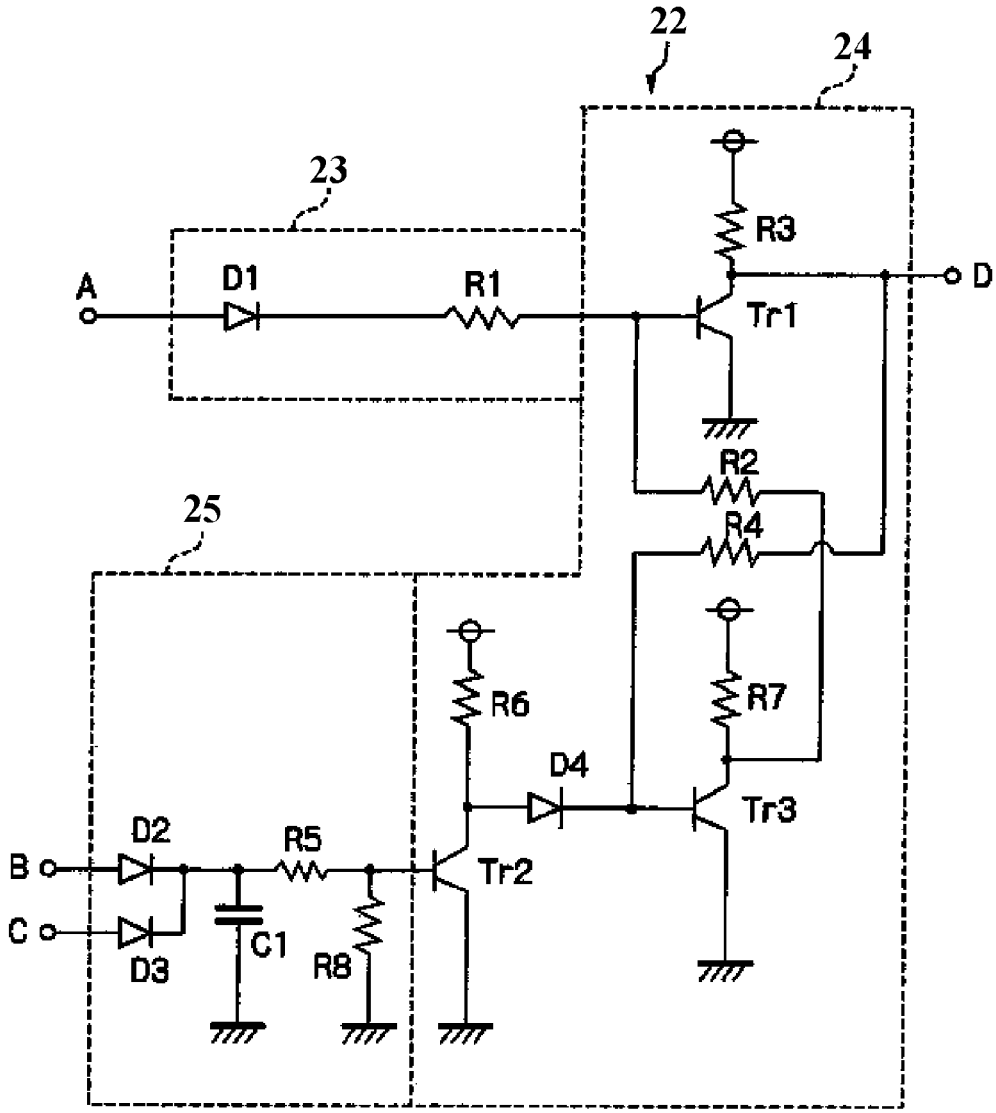
FIG. 2 is a circuit diagram of the kickback preventing circuit incorporating the invention.
Figure 3:
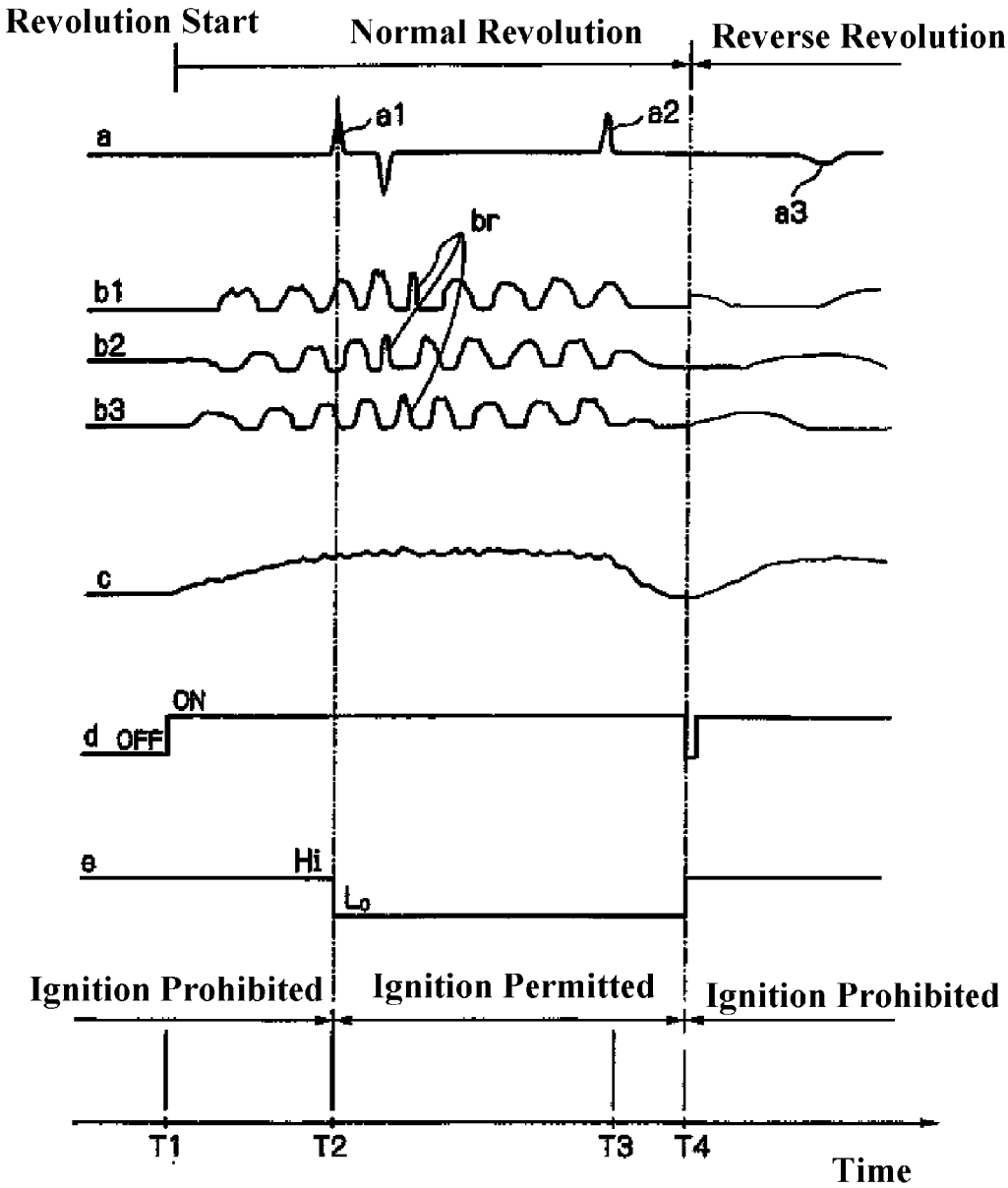
FIG. 3 is a time chart showing certain outputs of the circuit and its components.

The way the kickback preventing circuit 22 operates may be best understood by reference to FIG. 3 which is a time chart showing input and output signals of the respective circuits constituting the kickback preventing circuit 22. When a cranking operation is initiated at a time point T1, the crankshaft starts rotating through the operation of the starting device which may be a starter motor, a kick starter, a crank or a pull rope. As seen in curve a, a positive pulse signal a1 is produced at the time point T2. This curve (a) shows the waveform of the pulse signal supplied from the pulser coil 14 to the pulse receiving circuit 23 through the terminal A (FIG. 2).

Assuming there is a reverse rotation condition developing at the time T3, the revolution speed of the crankshaft starts decreasing at the time point T3 and will become zero at the time point T4. If not corrected the crankshaft will then reverse. This assumes that the operation of the starter has been discontinued because if not the engine speed will still be at that existent at the time T2 and the normal pulse pattern between the times T2 and T3 will continue to exist because the engine speed will be that as driven by the starter, particularly if an electric starter motor is employed.

As seen in curve a, a pair of positive and negative pulse signals with the first positive one previously identified as a1 will occur in the output from the pulser coil 14 per revolution of the crankshaft. These corresponding to leading and trailing ends of the projection on the crankshaft. side are obtained as detected with the pulser coil 14.

The described example shows a case in which reverse revolution might occurs before the projection is detected in the second revolution of the crankshaft. As noted, this shows a state in which, after the second, positive pulse signal a2 is obtained, the speed decreases and may reverse. As a result, the time point of the pulse signal a3 is delayed due to the low speed, and the pulse output is low.

Continuing to refer to FIG. 3, the output voltage waveforms of the three phases of U, V, and W of the generator 111 (FIG. 1) are shown by the curves b1, b2, and b3. The narrow waveforms indicated by the curve portions br in the respective waveforms show the state where part of the generator output is grounded by the regulator 13 (FIG. 1) to prevent the generator output from becoming too great.

The curve (c) shows the output waveform of the generator output receiving circuit 25 made by synthesizing two phases of output voltages received by through the terminals B and C (FIG. 2). The compound output voltage is the voltage by which the capacitor C1 (FIG. 2) is charged. The voltage increases gradually after the start of the crankshaft revolution, and which is maintained at a constant value by the regulator 13. As seen in FIG. 3 this starts decreasing at the time point T3 with the decrease in the crankshaft revolution speed. When the revolution speed becomes zero at the time point T4, the voltage also becomes zero or almost zero.

The output voltage waveform of the transistor Tr2 (FIG. 2) of the reverse revolution discriminating circuit 24 is shown by the curve d in FIG. 3. The transistor Tr2 is turned off when the generator output voltage, curve, relative to the capacitor C1 is zero or a specified low value, is turned on when the voltage increases to a specified value above the low value set and is turned back to off when the voltage decreases again to the set low value.

In the specific example shown, the transistor Tr2 turns on at the time point (nearly the same as the time point T1) when the voltage curve c comes to a specified value that is slightly higher than zero with a slight delay after the revolution start (time point T1).

The transistor Tr2 remains on as long as the voltage is equal to or above the specified value slightly larger than zero. It turns off at the time point T4 when the voltage decreases to the specified low value and the revolution speed comes to zero and the reverse revolution is started.

Continuing to refer to FIG. 3, the curve e shows the waveform of the output from the output terminal D of the reverse revolution discriminating circuit 24. The reverse revolution discriminating circuit 24 switches from Hi to Lo at the time point T2 when a positive pulse signal a1 is supplied while the transistor Tr2 is on. It switches from Lo to Hi at the time point T4 when the transistor Tr2 turns off. Ignition is prohibited when the output terminal D is Hi, and ignition is permitted when the output is Lo. Thus the engine will not be permitted to run in a reverse direction and will stop until restarted again.

Figure 4:
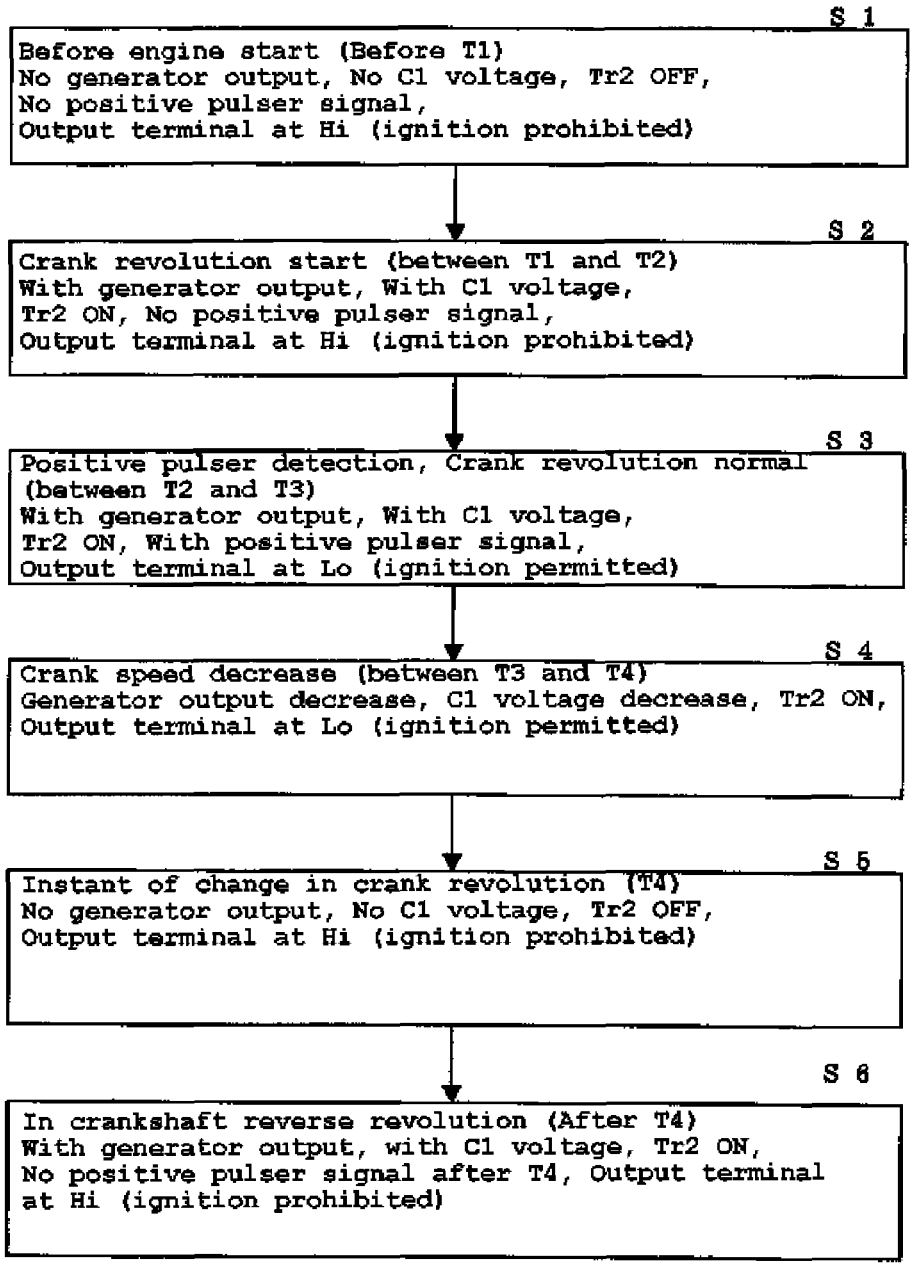
FIG. 4 is a block diagram explaining the control routine.

Referring now to FIG. 4, this is a functional flowchart of the operation of the kickback preventing circuit. At start the Step S1 corresponds to the period with the crankshaft at rest before being rotated at the time point T1 (FIG. 3), or before the engine start (before a cranking operation). Here, ignition is prohibited as the output terminal D is set to Hi, as explained in reference to FIG. 3, without generator output, without capacitor voltage, with the transistor Tr2 off, and without a positive pulse signal.

The Step S2 corresponds to the period between the time points T1 and T2, or between the cranking start and the first supply of a positive pulse signal a1. The transistor Tr2 is turned on as the generator output increases and the voltage relative to the capacitor C1 is not lower than the specified low value. Although the transistor Tr2 is turned on here, the output terminal D remains at Hi in the state of ignition prohibited because no first positive pulse signal has been supplied. The Step S3 corresponds to the period between the time point T2 at which a first positive pulse signal a1 is supplied after the crankshaft starting revolution and T3 at which the crankshaft starts losing rotating energy to slow down due to the start of reverse rotation. In this state, the generator output is high, and the capacitor voltage is not lower than the specified low value, and the transistor Tr2 is on. As the positive pulse signal is supplied in this state and the output terminal D is set to Lo, ignition is permitted.

The Step S4 corresponds to the period between the time points T3 and T4, the period in which the crankshaft slows down and its speed reaches zero. Although the generator output decreases and the capacitor voltage decreases, the voltage is not lower than the specified low value and the transistor remains on, the output terminal D is set to Lo, and ignition remains permitted.

The Step 5 corresponds to the time point T4 at which the rotating direction of the crankshaft changes from normal to reverse. In this state, no generator output is present, the capacitor voltage decreases below the specified low value. As a result, the transistor Tr2 is set to off, the output terminal D is set to Hi, and ignition is prohibited.

The Step S6 corresponds to the state of the crankshaft in reverse revolution after the time point T4. As the crankshaft rotates in the reverse direction, generator output is produced to turn the Tr2 on. However, a positive pulse signal is not supplied after the ignition-prohibited state is brought about. Therefore, the ignition-prohibited state persists and kickback is prevented.

The ignition-prohibited state is reset and the ignition permitting state is brought about again when a new pulse signal is supplied as the crankshaft starts revolution by a next cranking operation with a kick pedal or starter motor.

Thus from the foregoing description it should be readily apparent that the described ignition control circuit and its method of operation provides a very simple but highly effective prevention of engine reverse rotation upon starting by prohibiting ignition when a reverse rotation situation arises. Of course those skilled in the art will readily recognize that the foregoing description is that of preferred embodiments but various changes and modifications thereof are possible without departing from the spirit and scope of the invention, as defined by the appended claims.

What is claimed is:

1. A reverse rotation preventing circuit, the reverse rotation preventing circuit comprising:

a generator output receiving circuit to which a three-phase input or a two-phase input of a generator connected to a crankshaft of an engine is inputted;

a pulse receiving circuit to which one positive or one negative pulse signal is inputted per one revolution of the crankshaft; and a reverse revolution discriminating circuit arranged to discriminate a reverse revolution of the crankshaft based on an output from the generator, the reverse revolution discriminating circuit being connected to an ignition circuit; wherein the reverse revolution discriminating circuit is arranged to output an ignition prohibiting signal when a revolution speed of the crankshaft decreases after an initiation of a revolution of the crankshaft and the generator output becomes below a predetermined amount; and the reverse revolution discriminating circuit is arranged to maintain an ignition prohibiting state until a first positive pulse signal is inputted when the crankshaft is rotated by a new cranking operation.

2. The reverse rotation preventing circuit as recited in claim 1, wherein the generator output receiving circuit includes backflow preventing diodes each connected to a three-phase or two-phase output signal line of the generator, a capacitor arranged to be charged by the generator output, and a resistor connected between the capacitor and the reverse revolution discriminating circuit.

3. The reverse rotation preventing circuit as recited in claim 2, wherein the reverse revolution discriminating circuit includes a flip-flop circuit connected to the pulse receiving circuit, and a transistor circuit connected between the flip-flop circuit and the resistor of the generator output receiving circuit.

4. The reverse rotation preventing circuit as recited in claim 3, wherein the reverse revolution discriminating circuit is arranged to permit ignition only when an output of the transistor circuit is in an ON state and the positive pulse signal is inputted.

* * * * *